US005984646A

United States Patent [19]

Renfro et al.

[11] Patent Number: 5,984,646

[45] Date of Patent: Nov. 16, 1999

[54] HYDRAULIC MOTOR FOR USE WITH AIRLESS PAINT SPRAYER SYSTEM

[75] Inventors: Wesley E. Renfro, Burton; Charles T. Scholl, Shaker Heights, both of Ohio

[73] Assignee: Accuspray, Inc., Cleveland, Ohio

[21] Appl. No.: 09/005,702

[22] Filed: Jan. 12, 1998

Related U.S. Application Data

[60] Provisional application No. 60/043,774, Apr. 11, 1997.

[51] Int. Cl.[6] ..... F04B 47/08

[52] U.S. Cl. ..... 417/375; 417/554

[58] Field of Search ..... 417/375, 554

[56] References Cited

U.S. PATENT DOCUMENTS

| | | | |
|---|---|---|---|
| 2,787,961 | 4/1957 | Chenault | 417/375 |
| 3,945,768 | 3/1976 | Georgi . | |
| 3,945,774 | 3/1976 | Doan | 417/554 |
| 4,684,062 | 8/1987 | Bagwell . | |
| 4,756,235 | 7/1988 | Cartner . | |
| 4,785,997 | 11/1988 | Liska et al. . | |
| 4,792,291 | 12/1988 | Kvinge et al. . | |
| 5,031,509 | 7/1991 | Cowan . | |
| 5,165,875 | 11/1992 | Lebret | 417/554 |
| 5,249,645 | 10/1993 | Wiklund | 417/375 |
| 5,382,142 | 1/1995 | Spears | 417/554 |

*Primary Examiner*—John Kwon

*Attorney, Agent, or Firm*—Fay, Sharpe, Fagan, Minnich & McKee, LLP

[57] ABSTRACT

A reciprocating hydraulic motor and pump assembly includes a cylinder and a piston disposed for reciprocation in the cylinder. The piston includes a stem having a bore extending longitudinally in the stem and a piston head connected to one end of the stem. The piston head includes a cavity communicating with the bore. A spool is slidably mounted in the stem bore and the piston head cavity. A magnetic latching assembly is disposed in the piston head cavity. A displacement rod is fastened to the piston rod. The hydraulic motor and pump assembly is used in an airless paint sprayer system.

20 Claims, 11 Drawing Sheets

HYDRAULIC MOTOR FOR USE WITH AIRLESS PAINT SPRAYER SYSTEM

This application bases its priority on provisional application, Ser. No. 60/043,774 which was filed on Apr. 11, 1997.

BACKGROUND OF THE INVENTION

The present invention relates to improvements in a hydraulic motor. More specifically, the present invention relates to a hydraulic motor coupled to a pump employing a reciprocating piston. One use for such motors is to supply slurries of paint or other coating compositions to the several spray heads of an airless paint sprayer system.

Hydraulic motors used with reciprocating pistons for airless paint sprayers have been employed in the past. One known manufacturer of such a hydraulic motor is The Speeflo Division of Titan Tool, Inc. of Roslyn, N.Y. Other known manufacturers of hydraulic motors for airless paint sprayer systems include Graco, Inc. of Minneapolis, Minne., Durotech Co. of Moorpark, Calif. and Airlessco of Orange, Calif. A known Speeflo pump design of Titan employs a differential area piston with a spool valve to drive the pump up and down. Hydraulic pressure is always directed to the bottom side of the piston, and the valve alternately applies and removes pressure from the larger top side of the piston. A pair of ball detent latching mechanisms serves to maintain the spool valve in one of two possible end positions.

One of the problems with the known Speeflo pump design is that the spool rides in a spool sleeve which must match the spool diameter within about 0.0003 inches. When any wear occurs at the interface between the spool and the sleeve, leakage from the high pressure supply side to the no pressure exhaust side increases rapidly. This leakage causes frictional heating of the hydraulic fluid and lowers the pump's performance, i.e. its maximum pressure and flow rate. In addition, the ball riding over the detent ridge on the spool causes wear on both parts. The springs loading the ball eventually also fail, generating debris which can damage the spool valve. Typically, two balls are used in opposition to each other on the spool. While this keeps the spool centered between the two—and is a better design than employing a single spring loaded ball valve—the two balls still try to force the spool to move off axis, in a direction perpendicular to the ball loading. Such angulation causes wear on both the spool and the sleeve.

In addition, whether the spool needs replacing due to wear on its detent ridge from the ball, or due to scoring from debris, both the spool and the sleeve must be replaced as a set. In order to achieve the tight clearance that is necessary between the spool and the sleeve, they need to be made in sets.

Ideally, the shift distance for the pump should be as small as possible in order to maximize efficiency, limited only by the flow area requirements for fluid passages and to allow for a seal between the two sides. However, the use of a ball detent increases the minimum shift distance due to the space required for the ball to be in both the up and the down positions and the size of the detent ridge. Larger balls in the ball detent mechanism and larger detent ridges are desirable to lower the stresses on and to improve the life of the latching mechanism. But, they also lengthen the shift distance and reduce the efficiency of the pump. In addition, the movement of the ball during the shift from one end position to the opposing end position in the pump, as the trip rod spring loads up, contributes to a longer shift time, during which the spool is not in either a fully up or a fully down position.

Another known hydraulic motor for an airless paint sprayer system is disclosed in U.S. Pat. No. 4,785,997 dated Nov. 22, 1988 and assigned to Durotech Co. of Moorpark, Calif. This hydraulic motor includes a releasable stop means having balls and grooves wherein the construction of the same will assure a rotation of the balls to prevent uneven wear of the balls and the grooves. However, since this known arrangement also employs balls and grooves, it has the same disadvantages as mentioned above with regard to the Speeflo design.

Accordingly, it is desirable to develop a new and improved hydraulic motor which would overcome the foregoing difficulties and others while providing better and more advantageous overall results.

BRIEF SUMMARY OF THE INVENTION

According to the present invention, a new and improved reciprocating hydraulic motor and pump assembly is provided.

More particularly in accordance with this aspect of the invention, the assembly comprises a cylinder and a piston disposed for reciprocation in the cylinder. The piston comprises a stem, a bore extending longitudinally in the stem and a piston head connected to one end of the stem. The piston head includes a cavity communicating with the bore. A spool is disposed for longitudinal movement in the stem bore and the piston head cavity. A magnetic latching assembly is disposed in the piston head cavity.

In accordance with another aspect of the present invention, a reciprocating hydraulic motor and pump assembly for an airless paint sprayer system is provided.

More particularly in accordance with this aspect of the invention, the assembly comprises a cylinder and a piston disposed for reciprocation in the cylinder. The piston comprises a stem having a bore extending longitudinally in the stem and a piston head connected to one end of the stem, the piston head including a cavity communicating with the bore. A spool is slidably mounted in the stem bore and the piston head cavity. A magnetic latching assembly is disposed in the piston head cavity and a displacement rod is fastened to the piston rod.

In accordance with yet another aspect of the present invention, a reciprocating hydraulic motor and pump assembly is provided.

In accordance with this aspect of the invention, the assembly comprises a cylinder and a piston disposed for reciprocation in the cylinder, the piston comprising a stem having a bore extending longitudinally therein and a piston head connected to one end of the stem, the piston head including a cavity communicating with the bore. A spool is disposed for longitudinal movement in the stem bore and the piston cavity. A magnetic latching assembly is disposed in the piston head cavity. The latching assembly comprises a first latch plate located adjacent one end of the piston head cavity and a second latch plate located adjacent another end of the piston head cavity. A magnetic plate is slidably mounted on the spool and is located in the piston head cavity. The magnetic plate is reciprocated between the first latch plate and the second latch plate by a movement of the spool.

One advantage of the present invention is the provision of a new and improved hydraulic motor which is particularly adapted for use with an airless paint sprayer system.

Another advantage of the present invention is the provision of a hydraulic motor which employs a magnet assembly as the releasable stop means for the motor. The magnet assembly has essentially no wear and produces no debris which could damage other components. In addition, the magnet assembly will actually remove any wear debris generated by other components, such as the hydraulic pump, as long as such debris is ferromagnetic.

Still another advantage of the present invention is the provision of a hydraulic motor employing a magnetic latching means wherein a magnet assembly is allowed to "float" on a spool used in the hydraulic motor so that it does not interfere with alignment of the spool. The magnet assembly keeps the spool entirely in either the up position or the down position for as long as possible during each stroke, thereby maximizing stroke efficiency. In addition, a magnet assembly provides no lower limit to the theoretical switch distance. As a result, the switch can be shorter and, therefore, more efficient than the prior art switches because it is limited only by fluid sealing and flow area requirements.

Yet another advantage of the present invention is the provision of a hydraulic motor having an improved spool valve design which eliminates spool travel in the piston. Since the spool valve travels with the piston, there is no need for a spool valve sleeve. Elimination of the valve sleeve also eliminates one of the three external hydraulic connections, which was necessary in the prior art design, thereby eliminating a potential leak site.

An additional advantage of the present invention is the provision of a hydraulic motor employing a piston and a trip rod assembly in which the trip rod assembly does not have to be factory preset. When one of the springs of the trip rod breaks, the user can replace the broken trip rod spring instead of needing to replace the entire trip rod assembly as in the prior art.

A further advantage of the present invention is the provision of a hydraulic motor which employs removable and replaceable metal seals which are separate from a spool of the motor. The metal seals are either self-energized or are energized by a backing elastomer layer to maintain surface contact for positive seal against a piston and are expandable so that when they do wear, the seal can be maintained in an "as new" condition. In addition, when the seals need to be replaced, they can be replaced at a relatively low cost without having to replace the entire spool and sleeve assembly.

A yet further advantage of the present invention is the provision of a hydraulic pump having a new and improved hydraulic feedback loop to adjust the position of the swashplate of the hydraulic pump. As pressure increases, the effect is to lower the volume demanded of the pump which makes it easier for the power supply to meet demand. To the user, the effect is a smoother, steadier supply of the pumped product, especially at high pressures.

Still other benefits and advantages of the present invention will become apparent to those skilled in the art upon a reading and understanding of the following detailed specification.

BRIEF DESCRIPTION OF THE DRAWINGS

The invention may take form in certain components and structures, preferred embodiments of which will be described in detail in the specification and illustrated in the accompanying drawings, wherein.

DETAILED DESCRIPTION OF THE PREFERRED EMBODIMENTS

Figure 1:
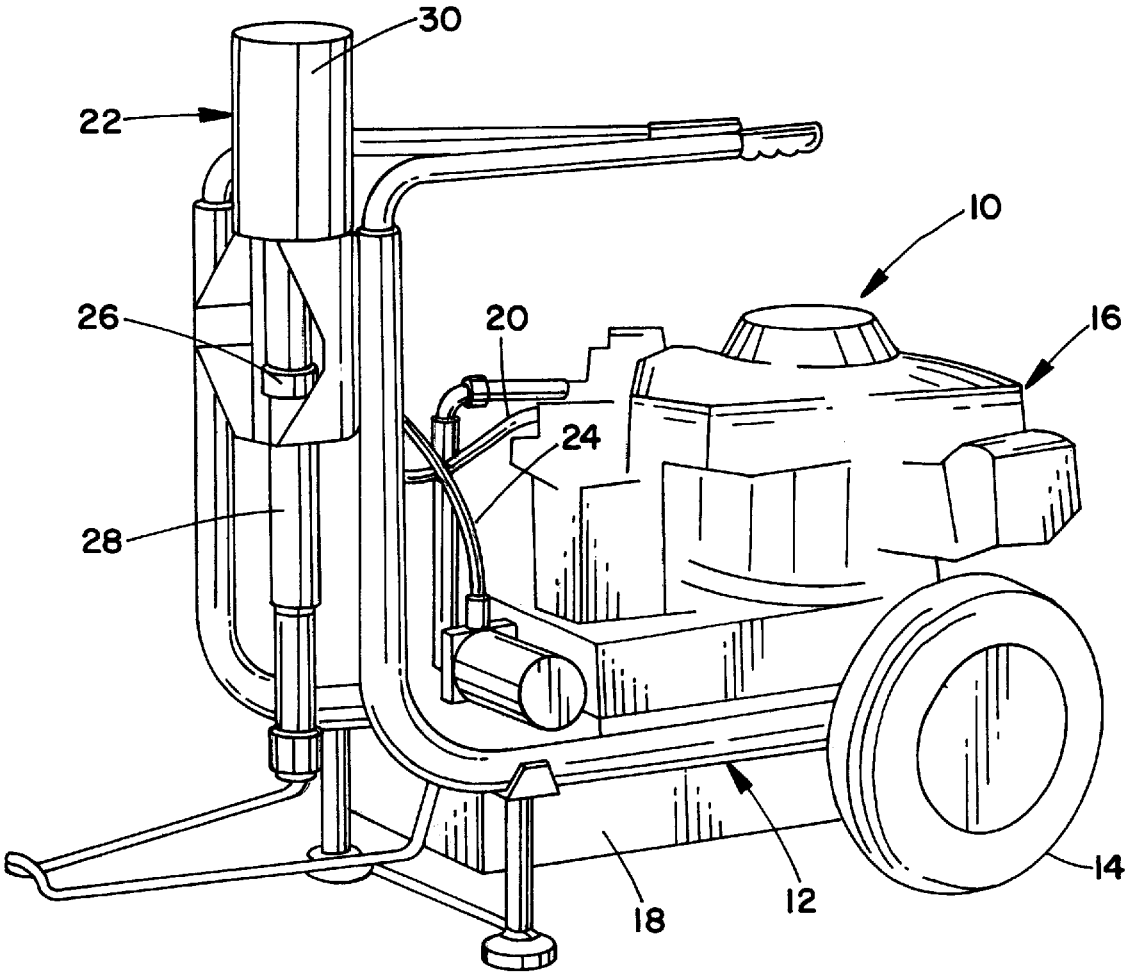
FIG. 1 (PRIOR ART)
FIG. 1 is a perspective view of an airless paint sprayer with a hydraulic motor according to the prior art.

Referring now to the drawings wherein the showings are for purposes of illustrating preferred embodiments of the invention only and not for purposes of limiting same, FIG. 1 illustrates a conventional airless paint sprayer system generally designated by the numeral 10. The paint sprayer system includesla frame 12 mounted on wheels 14. Mounted on the frame 12 is an engine generally designated 16, which serves to move hydraulic fluid from a hydraulic fluid tank 18 through a pressure hose 20 to a hydraulic motor generally designated 22. Also provided is an outlet hose 24 which passes the hydraulic fluid from the hydraulic motor 22 back to the tank 18. Connected to the hydraulic motor 22 by a coupling 26 is a paint piston rod plunger 28 for reciprocation. The piston 28 sits in a container of paint (not shown) resting on the frame 12 and conventionally moves the paint to a known sprayer head for discharge.

Figure 2:
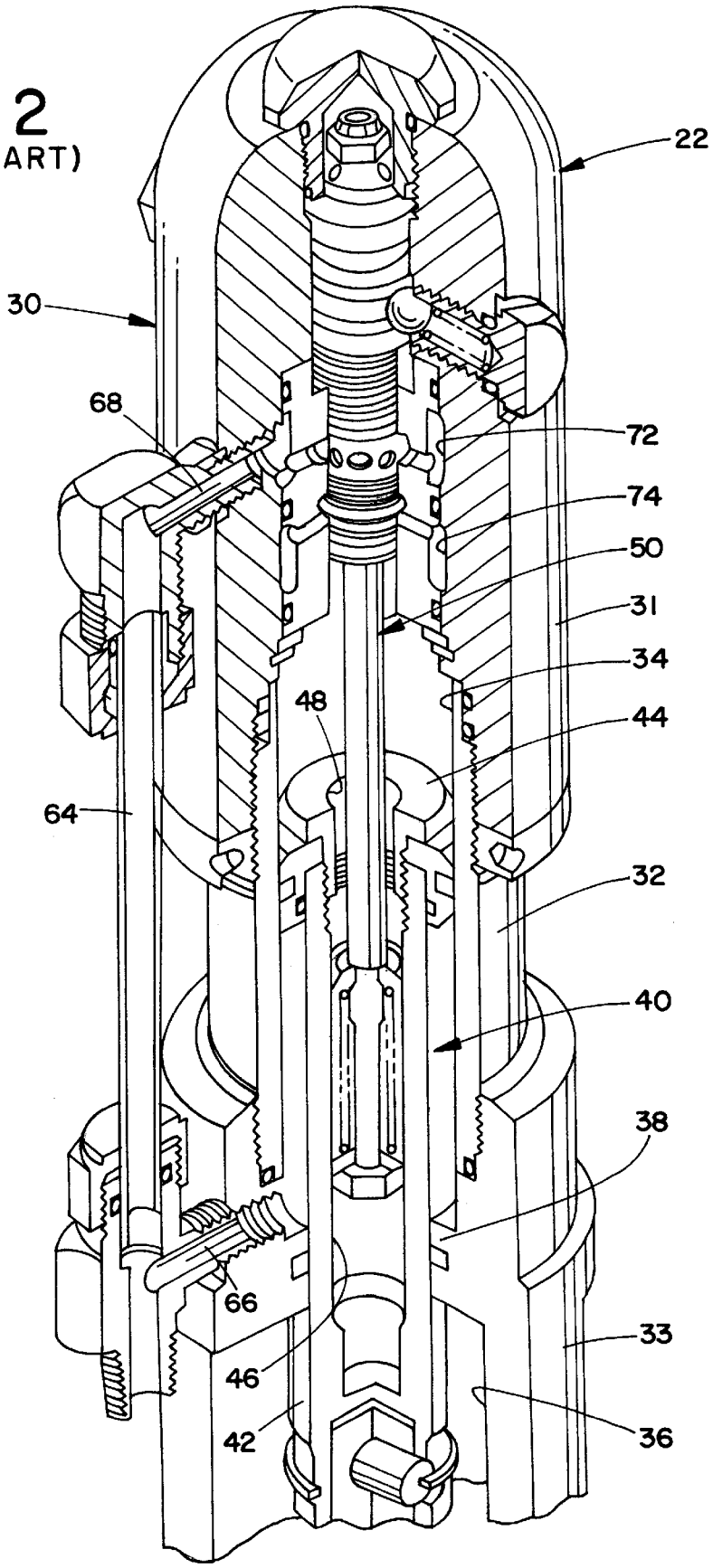
FIG. 2 (PRIOR ART)
FIG. 2 is an enlarged perspective view, partially in cross-section, of a hydraulic motor according to the prior art.

The conventional hydraulic motor 22 is more clearly illustrated in FIG. 2. This motor comprises a housing 30 having first, second and third casing sections 31, 32 and 33 which are suitably secured together as by conventional threads. Extending within the first and second sections 31 and 32 and into the third section 33 is a first bore 34. A second bore 36 extends in the third casing section 33 and is separated from the first bore 34 by a flange 38. Mounted for reciprocation within the pair of bores 34 and 36 is a piston rod assembly 40. This assembly includes a piston rod 42 having a piston 44 located on one end thereof. Located within the rod 42 is an interior chamber 46 that communicates with the first bore 34 via an aperture 48 in the piston 44.

Figure 3:
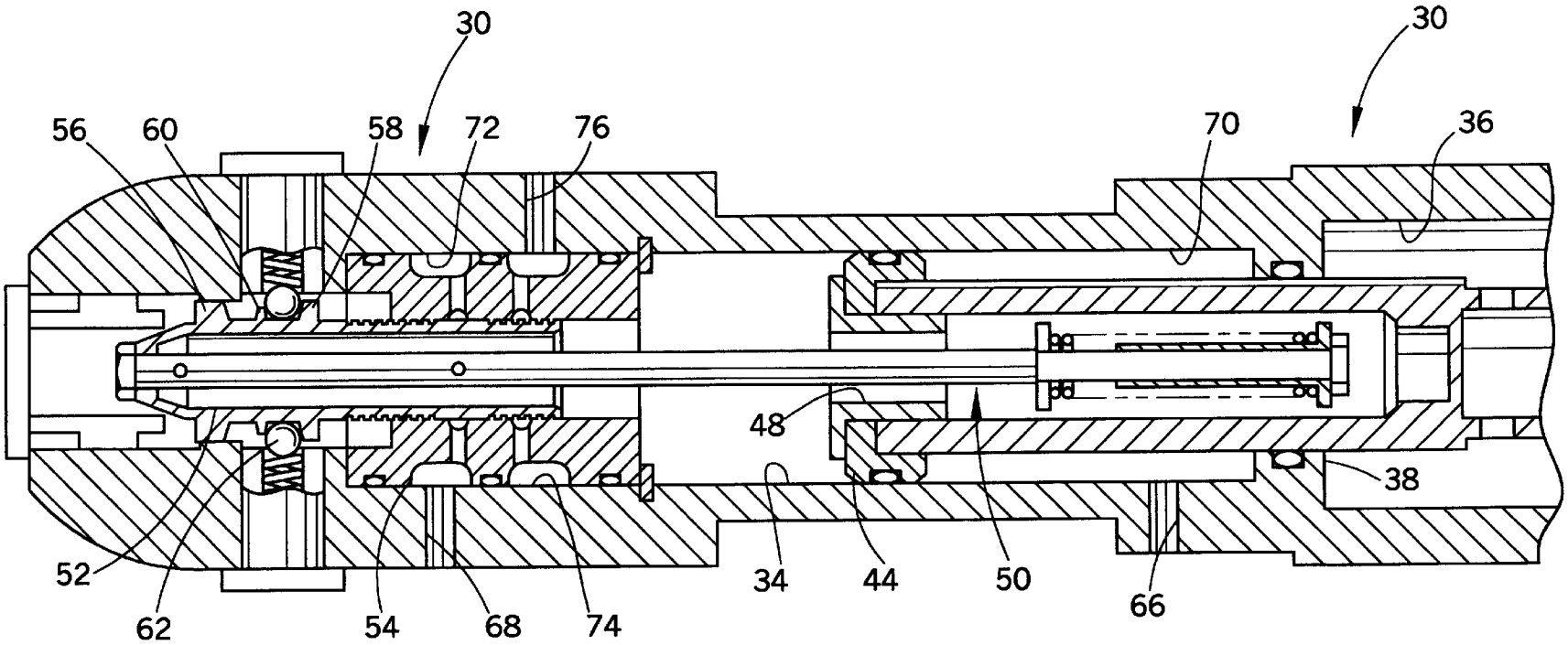
FIG.3 (PRIOR ART)
FIG. 3 is a side elevational view in cross-section of the prior art hydraulic motor of FIG. 2.

Mounted for reciprocation within the piston and rod assembly 40 is a trip rod assembly 50. With reference now also to FIG. 3, the trip rod assembly 50 cooperates with a spool valve 52. The spool valve reciprocates in a spool sleeve 54 fixedly mounted in the housing 30. The spool valve has an outer periphery on which is provided a first end shoulder 56 and, spaced therefrom, a second end shoulder 58. Located between the two end shoulders is a radially extending detent ridge 60. Contacting the outer circumference of the spool valve 52 are a pair of spaced spring biased ball detents 62. As is evident from FIG. 3, the ball detents contact the outer periphery of the spool valve on one or the other side of the detent ridge 60 depending on the position of the spool valve. The trip rod assembly reciprocates between its two end positions as defined by the shoulders 56 and 58 on the spool valve 52.

With reference again to FIG. 2, reciprocation of the trip rod assembly 50 is caused by hydraulic fluid supplied through a hydraulic fluid supply line 64 to a first inlet port 66 and a second inlet port 68. As shown in FIG. 3, the first inlet port 66 communicates with a first chamber 70 defined between a back face of the piston 44 and the flange 38. The second inlet port 68 communicates with a second chamber 72 defined between a first portion of the spool sleeve 54 and the housing 30. A third chamber 74, defined between a second portion of the spool sleeve 54 and the housing 30, communicates with a third or exhaust port 76. This known hydraulic motor and pump assembly has the disadvantages which have been set forth above.

Figure 4:
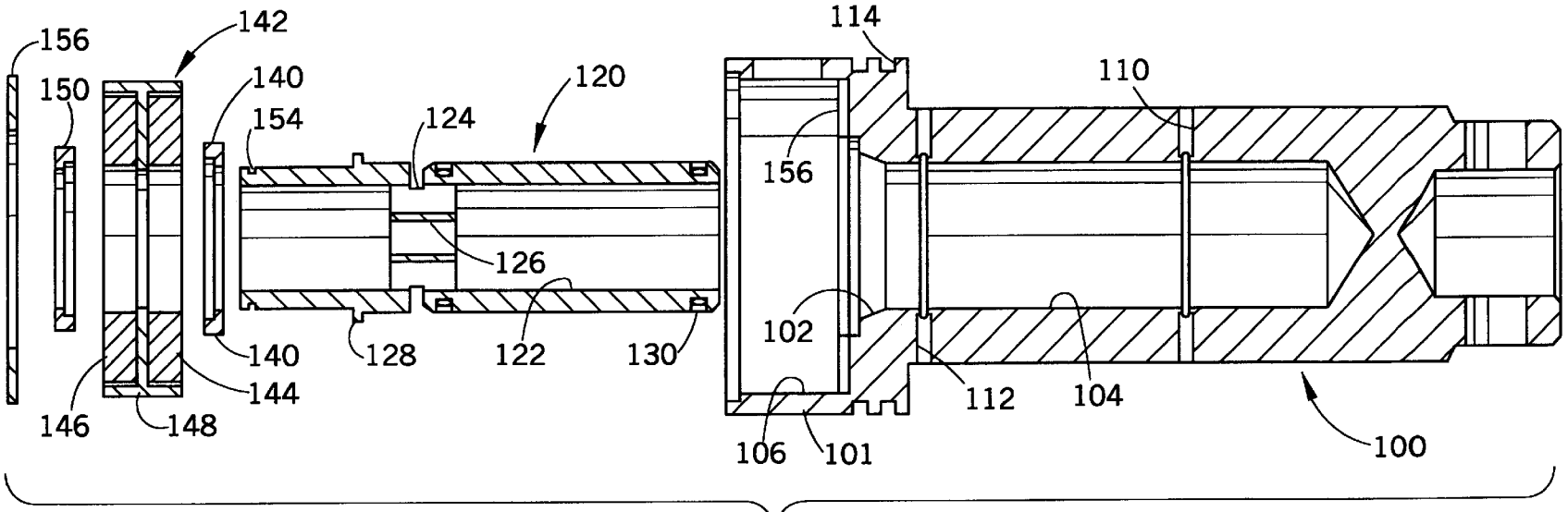
FIG. 4 is an exploded cross-sectional view of a hydraulic motor according to the present invention.

With reference now to FIG. 4, a hydraulic motor according to the present invention, includes a piston rod 100 located on one end of which is a piston 101. Defined therein is an interior chamber 102 having a first smaller diameter section 104, located in the piston rod 100, and a second larger diameter section 106, located in the piston 101. A first opening 110 extends radially through the piston rod from the interior chamber 104 to the exterior periphery of the piston rod. Spaced therefrom is a second opening 112 which similarly extends radially outwardly through the piston rod 100. A plurality of seal grooves 114 are located on the exterior periphery of the piston 101 adjacent the second larger diameter chamber section 106.

Mounted in the interior chamber 102 is a spool 120. The spool includes a central longitudinally extending bore 122. A radially extending aperture 124 in the spool 120 communicates with the central bore 122. Located in the bore 122 is a collar section 126 adjacent the aperture 124. The collar is used to mount a trip rod. Extending radially away from the outer periphery of the spool 120 is a flange 128. Provided in the outer periphery of the spool 120 are a pair of spaced grooves 130. Each of these grooves includes a seal assembly.

Figure 5B:
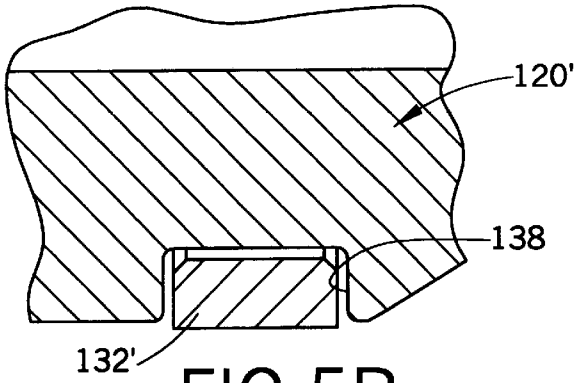
FIG. 5B is an enlarged cross-sectional view of a portion of a spool of the hydraulic motor of FIG. 4 according to an alternate embodiment of the present invention.
Figure 5A:
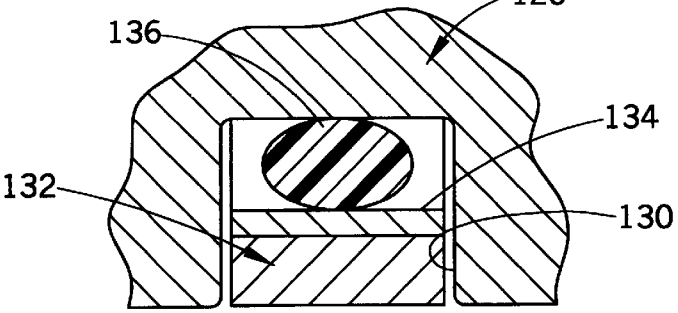
FIG. 5A is an enlarged cross-sectional view of a portion of a spool of the hydraulic motor of FIG. 4.

With reference now also to FIG. 5A, the seal assembly comprises a metal seal 132 which is supported by a backing metal band 134. Resiliently biasing the metal seal 132 radially outwardly is an elastomer O-ring 136. The material of the metal seal 132 is softer than the mating surface of the piston rod 100 against which it seals. Therefore, the wear part will be the metal seal 132 and not the piston rod wall. The metal seal can be replaced at relatively low cost. The joint in the backing metal band 134 is spaced away from the joint in the metal seal 132. The metal band serves to protect the elastomer O-ring 136 from being extruded by high pressure fluid into or past the metal seal 132.

FIG. 5B illustrates an alternate embodiment for the seal assembly. In this embodiment, like components are identified by like numerals with a primed (') suffix and new components are identified by new numerals. In this embodiment, a spool 120' is provided with a groove 138 for accommodating a metal seal 132'. In this embodiment, the seal is energized by its own spring action, due to a slight compression of the sealing ring as well as by the hydraulic fluid.

Cooperating with the flange 128 is a first spacer/shock absorber 140 which is mounted on the spool 120. Also mounted on the spool 120, adjacent the first spacer 140, is a magnetic latch assembly 142. The latch assembly includes a first toroidal magnet member 144 and a second toroidal magnet member 146. The two magnet members are mounted in a housing 148. Positioned on the second side of the latch assembly 142 is a second spacer/shock absorber 150. As is evident from FIG. 7, when the first spacer 140, latch assembly 142 and second spacer 150 are positioned on the spool 120, the first spacer 140 contacts the flange 128. The second spacer 150 is held in place via a snap ring 152, which extends into a groove 154 located on the outer periphery of the spool. In this way, the magnetic latch 142 is mounted on the spool 120. A pair of steel latching plates 156 is mounted on the piston 101. The outer latching plate 156 is held in place via a snap ring 158 mounted in a groove 160. The inner latching plate 156 is suitably secured to the piston.

Figure 6:
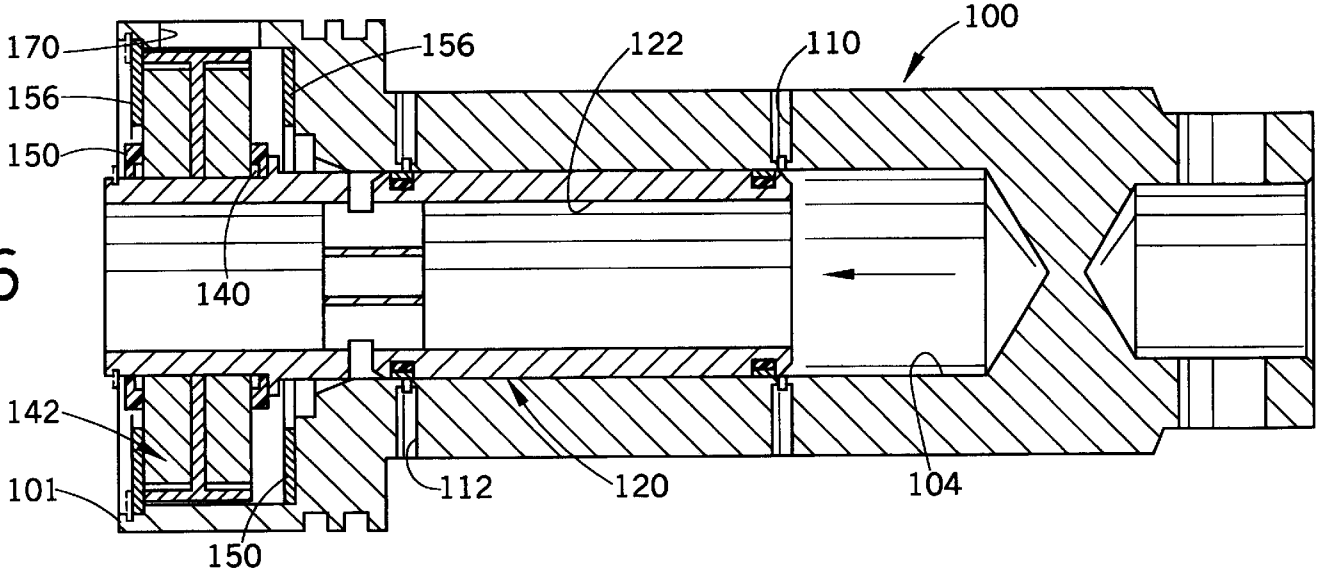
FIG. 6 is an assembled cross-sectional view of the motor of FIG. 4 in a first position of a spool thereof.

FIG. 6 illustrates the spool in a moving up position during which hydraulic fluid located above the piston 101 exhausts via the spool bore 122 and through aperture 110 that communicates with the smaller diameter section 104 of interior chamber 102. Pressurized hydraulic fluid, which is supplied via aperture 112, is not allowed into the interior chamber 102 of the piston assembly because of the sealing provided on the spool outer diameter by the seal means 132, 134, 136. The metal seal 132 is wider than the apertures or openings 110 and 112 in the piston rod 100 that the metal seal 132 rides over. In addition, the edges of the apertures in the piston rod 100 are rounded so as to prevent the seal 132 from being scored or gouged as the spool 120 reciprocates in the piston rod 100. The metal seal 132, as energized by the backing elastomer layer 136, provides a tighter clearance—and better sealing—than the seals of the prior art.

Figure 7:
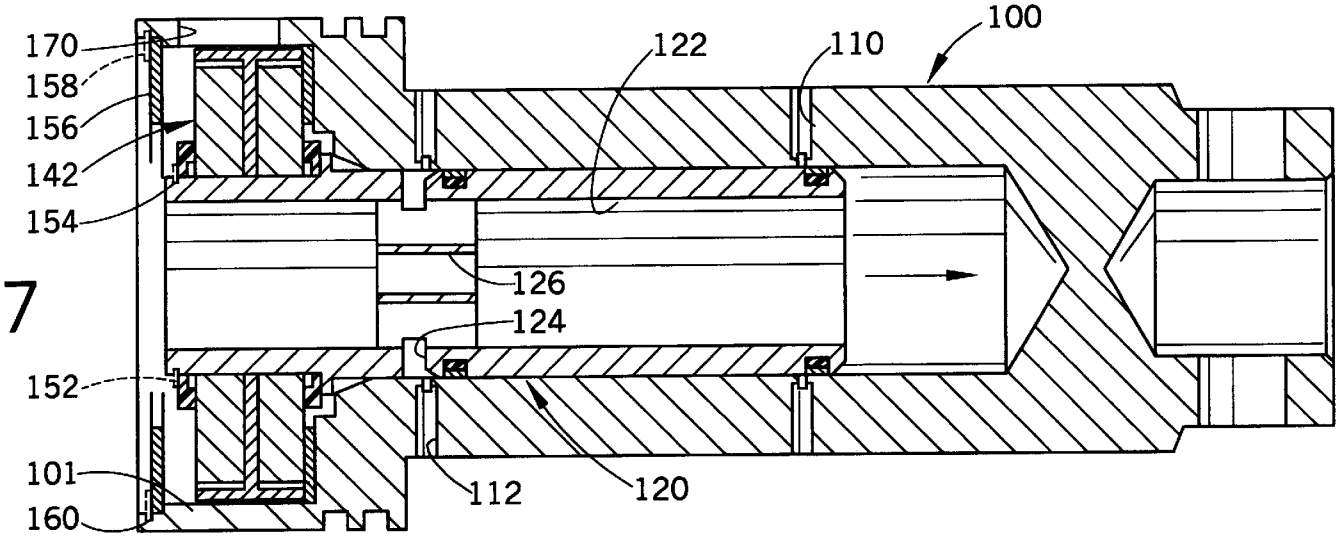
FIG. 7 is an assembled view of the motor of FIG. 4 in a second position of the spool thereof.

With reference now to FIG. 7, the assembly is there illustrated in a moving down position. In this position, pressurized hydraulic fluid is allowed into the central bore 122 of the spool 120 via the second opening 112 in the piston rod and the spool aperture 124. At the same time, exhaust of pressurized hydraulic fluid through the first opening 110 in the piston rod 100 is prevented by the seal means 132, 134, 136 on the spool. FIG. 6 also illustrates one of three spaced slotted holes 170 in the piston head cavity of the piston rod 100 adjacent the latch assembly 142. These holes 170 are necessary to allow fluid flow.

Figure 8:
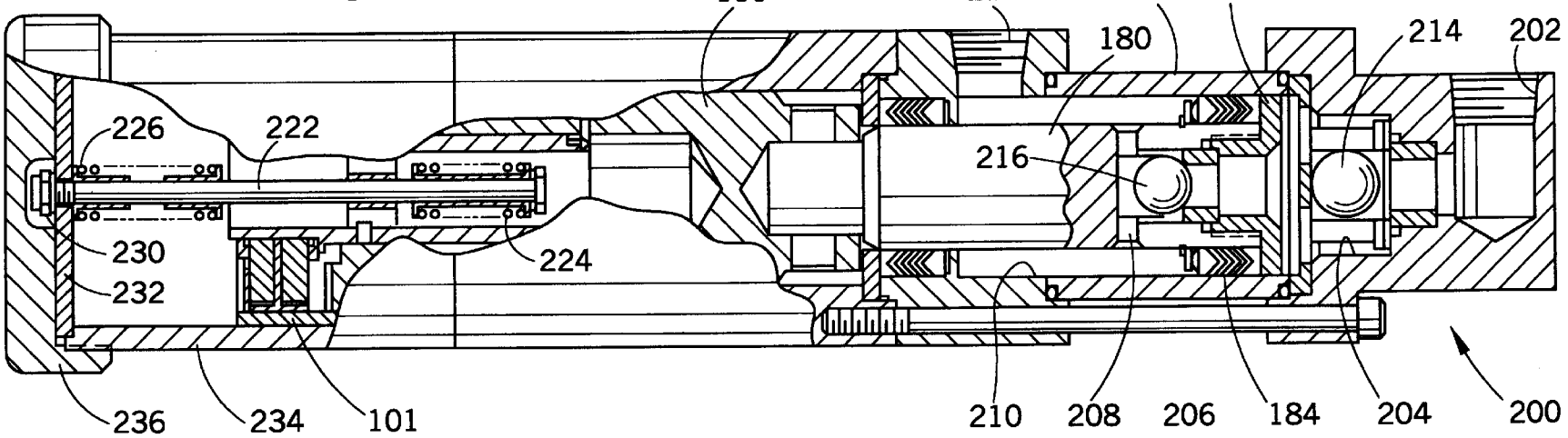
FIG. 8 is a cross-sectional view of the hydraulic pump and motor assembly according to the present invention with the displacement rod thereof being located at the beginning of an upstroke.

With reference now to FIG. 8, a displacement rod 180 according to the present invention is fastened to a lower end of the piston rod 100. Fastened to the displacement rod is a piston nut 182 for supporting a packing set 184. It can be appreciated that the packing set 184 seals against the cylinder portion 198 of a housing 200. A fluid, such as paint or the like, enters the housing 200 via an entry aperture 202. The fluid then flows through an internal passage 204. That internal passage communicates with an internal passage 206 in the displacement rod 180 as the piston nut 182 also has an aperture therein. The rod passage 206 communicates with an outlet aperture 208 in the piston rod. The aperture 208 allows the fluid to flow into a chamber 210 defined between the cylinder 198 and the displacement rod 180. An exit port 212 is also defined in the housing 200. It can be appreciated that reciprocation of the displacement rod 180 by reciprocation of the piston rod 100 will cause a pumping action of fluid in through the inlet port 202 and out through the exit port 212. A reverse flow of the fluid is prevented by the two check valves 214 and 216 illustrated in FIG. 8.

Figure 9:
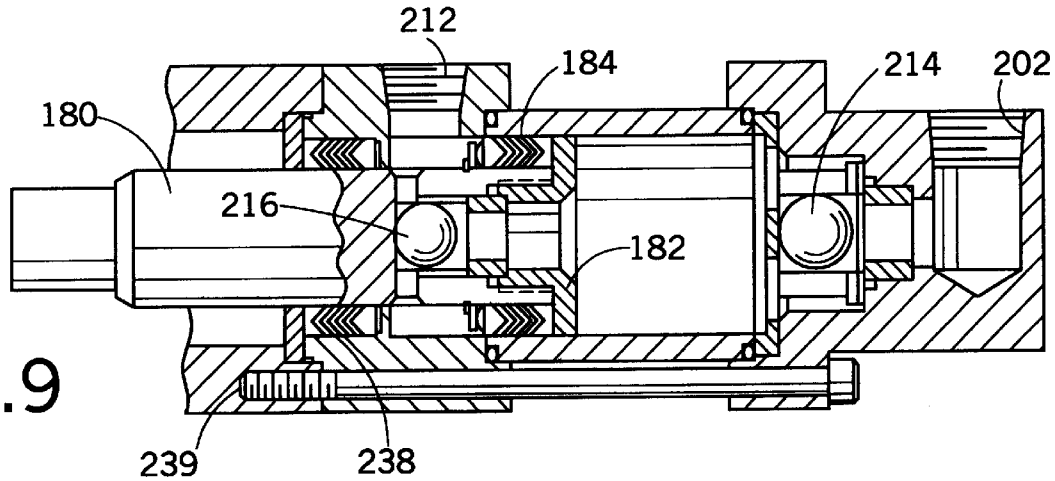
FIG. 9 is a cross-sectional view of a portion of the hydraulic pump end of FIG. 8 with the displacement rod thereof being located at the beginning of a downstroke.

FIG. 9 illustrates the displacement rod 180 at the beginning of the downstroke such that the first check valve 214 is closed and the second check valve 216 is open. In contrast, FIG. 8 illustrates the displacement rod 180 at the beginning of its upstroke. In this position the second check valve 216 is closed and the first check valve 214 is open.

It should also be appreciated from FIG. 8 that a resilient biasing means cooperates with the piston 101. More particularly, disposed in the interior chamber 102 defined in the piston rod 100 and piston 101, is a trip rod 222. Mounted on the trip rod is a first spring 224 located in the first diameter section 104 of the interior chamber 102. Mounted on the second end of the trip rod 222 is a second spring 226. An end of the trip rod, adjacent the second spring 226 is secured by a suitable nut 230 or the like to an end plate 232 of a cylinder 234 enclosing the piston 101. In this way, the trip rod remains stationary as the piston 101 reciprocates in the cylinder 234. A cap 236 is secured at one end of the cylinder 234.

FIG. 9 also illustrates a second packing set 238 located on the displacement rod 180 and spaced from the first packing set 184. Unlike the prior art pumps, the second packing set is held separately from the yoke block. This arrangement reduces costs in case the packing housing needs to be replaced. More specifically, the second packing set is held by a toroidal element 239 which can be selectively detached from the housing 200.

Figure 10:
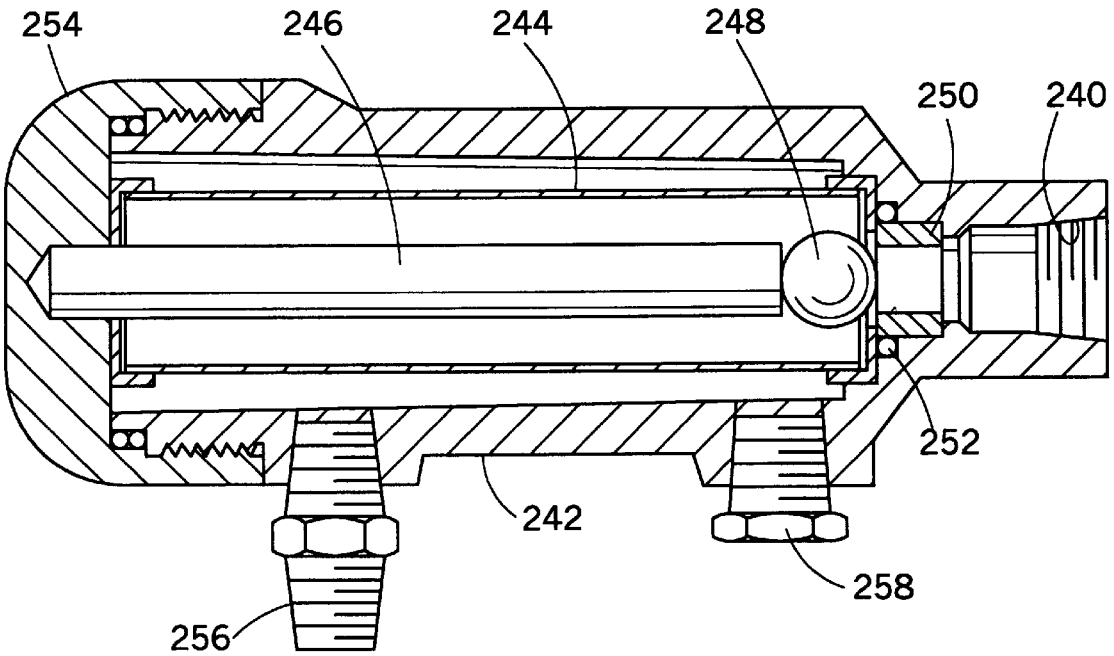
FIG. 10 is a cross-sectional view of a paint filter assembly communicating with the pump of FIG. 9, wherein the paint filter assembly has a ball valve with a reversible seat.

With reference now to FIG. 10, an inlet 240 of a filter body 242 communicates with the outlet 212 of the pump housing 200. The filter body comprises a filter element 244 inside which is located a ball stop rod 246 and a ball 248 which is seated on a reversible seat 250 located at the inlet 240 of the filter body. The seat is part of the built-in check valve which, because it is reversible, doubles the useful life of the seat. In addition, by not being brazed in, replacement involves only the seat and a seal 252 instead of the entire filter body. A cap 254 is located on one end of the filter body. A pair of spaced outlets 256 and 258 are located on the filter body.

Figure 11B:
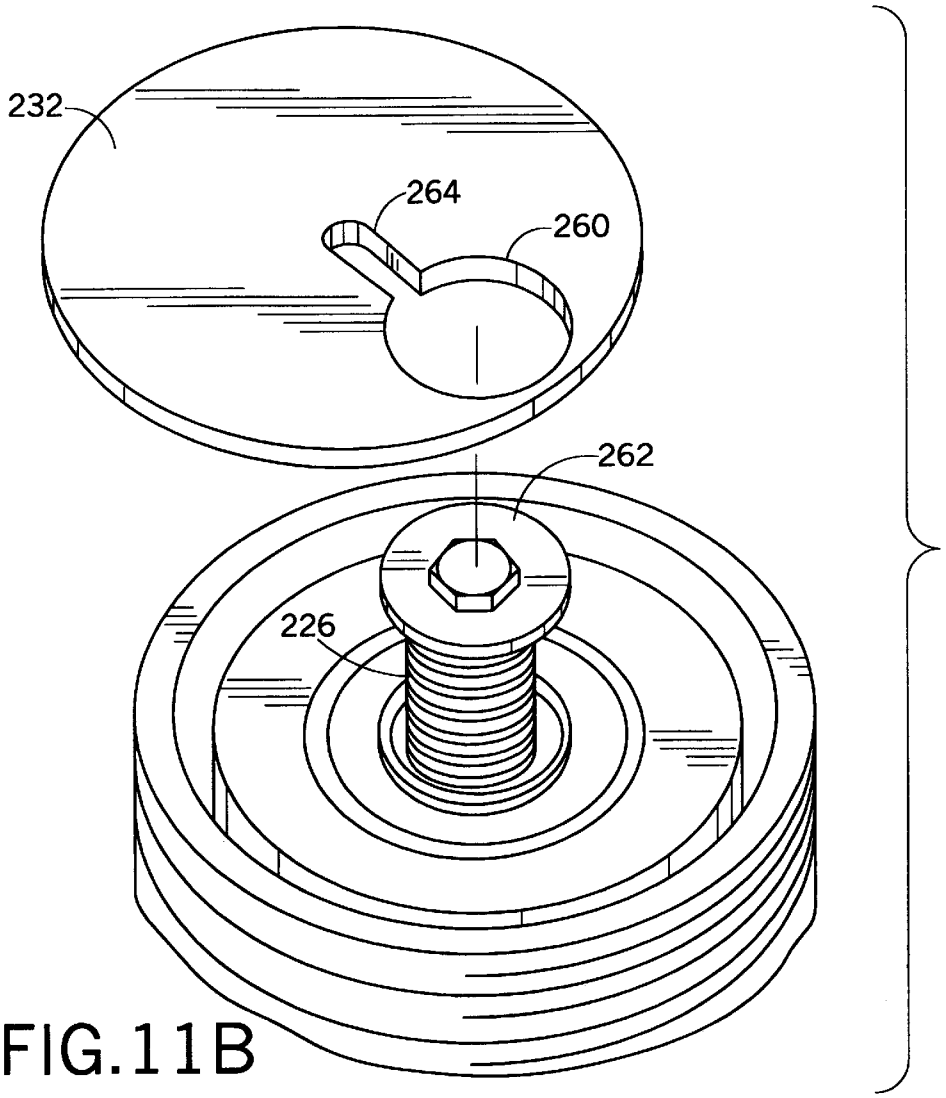
FIG. 11B is an enlarged exploded perspective view of the hydraulic pump and motor assembly of FIG. 9A with the end plate being exploded away and the cap being removed.
Figure 11A:
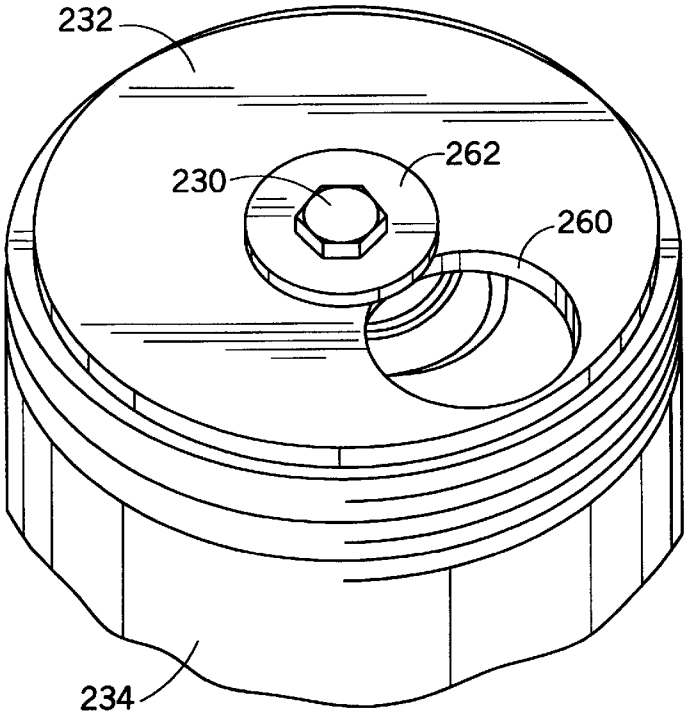
FIG. 11A is an enlarged exploded perspective view of an upper end of the pump and motor assembly of FIG. 9A with a cover plate thereof being removed to show an end plate thereof.

With reference now to FIG. 11A, the cap 236 is being shown as removed from the cylinder 234 thus exposing the end plate 232. It is evident that an enlarged aperture 260 is located in the end plate 232. The nut 230 includes a washer section 262. As can be seen from FIG. 11B, a slot 264 communicates with the aperture 260. The size of the washer section 262 is large enough to prevent the end plate 232 from being pulled away from the nut. However, when the cap 236 is removed and the end plate is slid so that the washer section of the nut overlies the aperture 260, the end plate can then be removed. In other words, the end plate has a keyway cut into it. Having this plate as a separate component and cutting an access hole into it, provides easy access to the upper internal components of the pump, including the trip rod 222, the spool 120, the seals and the piston. This design is advantageous over the conventional design which requires more tools and more effort to get at the corresponding components.

A conventional hydraulic pump employed with the hydraulic motor of the present invention is a variable displacement pump which has a set of cylinders arrayed in a circular pattern for pressurizing the hydraulic fluid. The cylinder's stroke is determined by the position of a swashplate which the cylinders act against. The pump has an external adjustment for setting the pump maximum operating pressure by setting the compression of a relief spring. When the pump's pressure reaches its maximum setting, the internal relief valve opens and moves the swashplate to a neutral position. Pressure therefore ceases to build. When pressure drops, the valve closes and the swashplate moves out of the neutral position. At this time, the cylinders begin building pressure again.

This type of hydraulic pump is conventionally used with hydraulic motors of airless spray paint equipment. A significant performance problem exists with such conventional hydraulic pumps. Since the volume of hydraulic fluid needed by the paint pump actually decreases above a certain pressure, the pump supplies hydraulic fluid at a volume greater than what is otherwise necessary above such pressure. With the swashplate set at its default maximum displacement, and therefore maximum hydraulic flow, until the maximum pressure is reached, the demand on the power supply (work=P×V) rises with pressure faster than otherwise required. To take a specific example, when the tip of a spray nozzle has an opening of 0.041 inches, paint at 2 gal/min. can be sprayed at 1900 psi. However, when the diameter of the opening is at 0.009 inches, at a pressure of 3000 psi, only ⅜th of a gallon of paint is sprayed per minute. But the conventional hydraulic pump continues to pump a larger than necessary volume of paint at this greater pressure.

Figure 12:
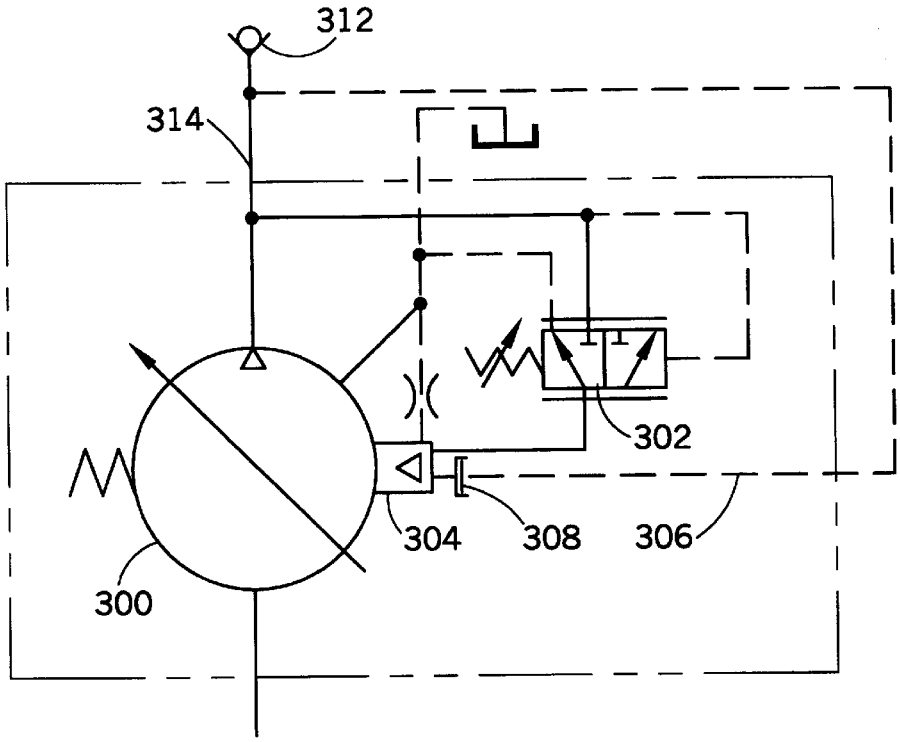
FIG. 12 is a hydraulic circuit diagram of a pump according to a first embodiment of the present invention.

With reference now to FIG. 12, a variable displacement pump 300 according to the present invention, is controlled by a pressure compensator valve 302. The pressure compensator valve 302 uses fluid pressure to move the swashplate of the pump 300 via a first piston 304 which is connected to the swashplate. When the pressure drops, the control valve closes and a spring (not illustrated) behind the first piston returns it to a fully open position. Also provided in the present invention is an outlet line 306 from the hydraulic pump. The output pressure of the hydraulic pump is used to drive a second piston 308 which adjusts the position of the swashplate of the pump 300. More specifically, the second piston 308 acts on the first piston 304 and in opposition to the action of the first piston. As pressure increases, the effect is to lower the volume demanded of the pump by the action of the first piston 304, which makes it easier for the power supply to meet demand. In other words, a parallel external control circuit is provided.

With the invention illustrated in FIG. 12, the diameter of the second piston 308 is smaller than is the diameter of the first piston 304. By sizing the diameter of the second piston 308, one can set the pressure at which the first piston 304 begins to move (i.e. the pressure at which that first piston's spring preload is overcome by the force exerted by the second piston). In the present invention, a second piston's diameter is sized so that the first piston 304 and the swashplate, begin to move at about 2500 psi. Below this pressure, the pump's volume output is at a maximum. This design is advantageous over a known horsepower limited design because it does not have the higher leakage, higher temperatures and, likely, higher costs that a horsepower limiter design would have.

Also provided is a check valve 312 downstream from the pump. The check valve is located in a hydraulic supply line 314 between the output and the hydraulic oil motor. The purpose for the check valve is to reduce detrimental feedback to the pump from the oil motor allowing the pump to run more smoothly and reducing output pressure swings in the oil motor. Such output pressure swings are known as "dead band" and can cause paint spray patterns to pulsate or "wink." Check valve 312 also improves the pressure characteristics of the pump allowing the pump to be operative at paint pressures of 300 to 400 psig. This is in comparison to the conventional pumps which are only operative down to about 450 psig.

Figure 13:
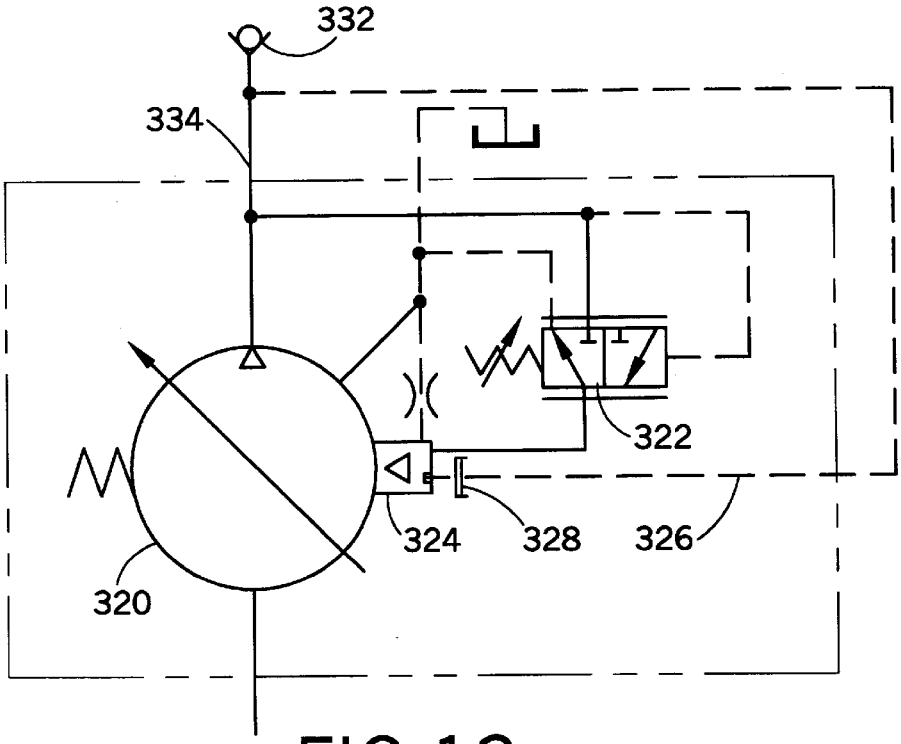
FIG. 13 is a hydraulic circuit diagram of a pump according to a second embodiment of the present invention.

With reference now to FIG. 13, another version of a pump control system is there illustrated. In this embodiment, a pump 320 is regulated by a pressure compensator valve 322. The pressure compensator valve 322 uses fluid pressure to move the swashplate of the pump 320 via a first piston 324 which is connected to the swashplate. An external line 326 is provided from the hydraulic pump output. The output pressure of the hydraulic pump is used to drive a second piston 328 which adjusts the position of the swashplate of the pump 320. Also provided is a check valve 332 located in an output line 334 of the assembly. In this embodiment, a slightly longer piston 328 is provided than the second piston 308 in FIG. 12. The increased length of the second piston 328 prevents the first piston 324, which is connected via a hydraulic line to the pressure compensator valve 322, from moving to a fully open position. This lowers the flow of fluid through the pump 320 and has a horsepower limiting effect. The version illustrated in FIG. 13 allows the use of a lower horsepower gas engine to power the pump 320 for a hydraulic motor (of the type shown in FIGS. 4–9) at the pressures require in an airless paint sprayer system. Normally, such a smaller engine would tend to stall were it not for the volume limiting feature of the hydraulic circuit illustrated in FIG. 13.

To the user, the effect of the hydraulic circuits illustrated in FIGS. 12 and 13 is a smoother, steadier supply of paint, especially at high pressure. Such circuits are known as volume limiters. Applicants have found that these hydraulic circuits and pump designs provide a noticeable performance difference in relationship to the known hydraulic pumps.

Figure 14:
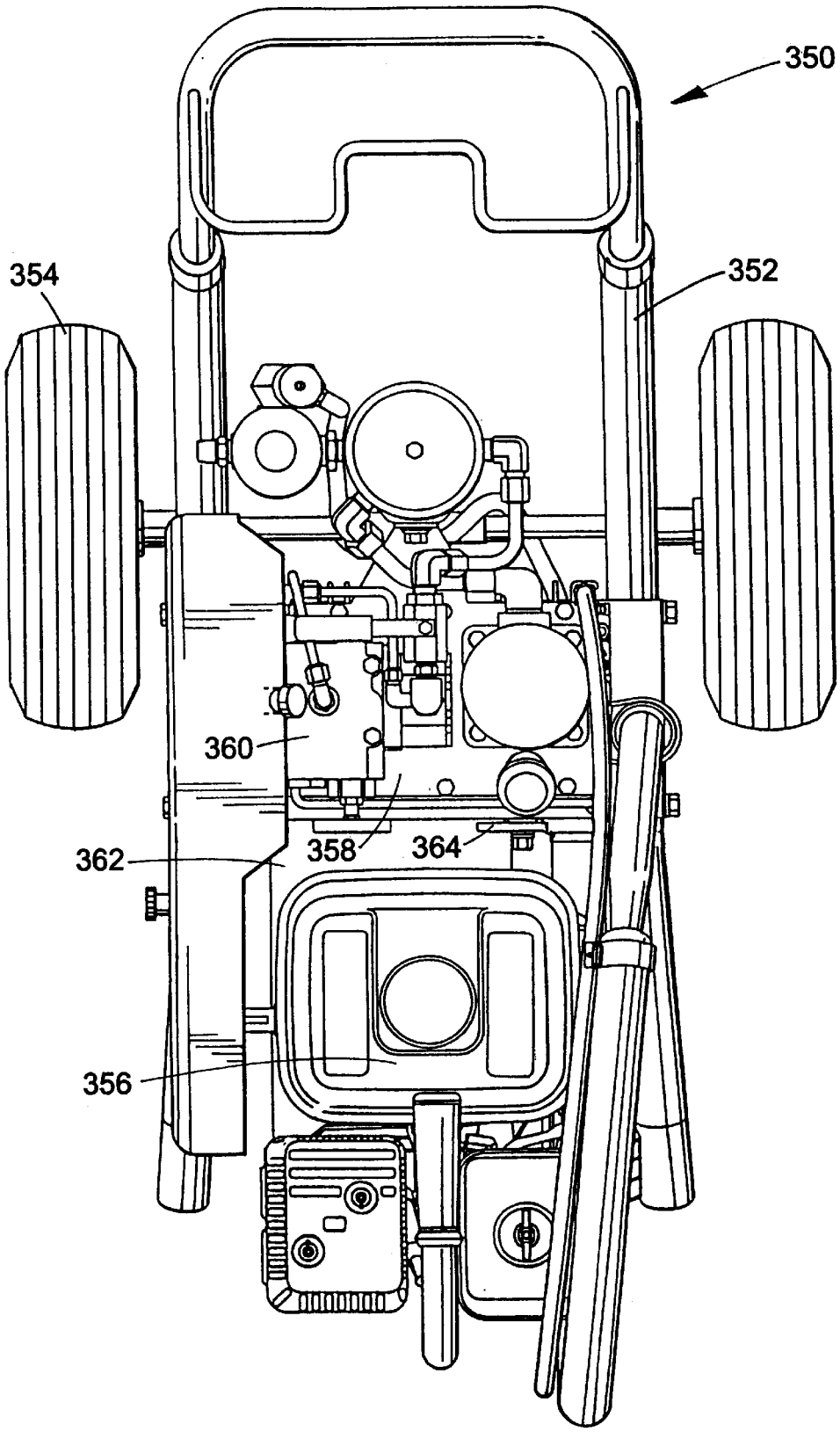
FIG. 14 is a top plan view of an airless paint sprayer with a hydraulic motor according to the present invention.
Figure 15:
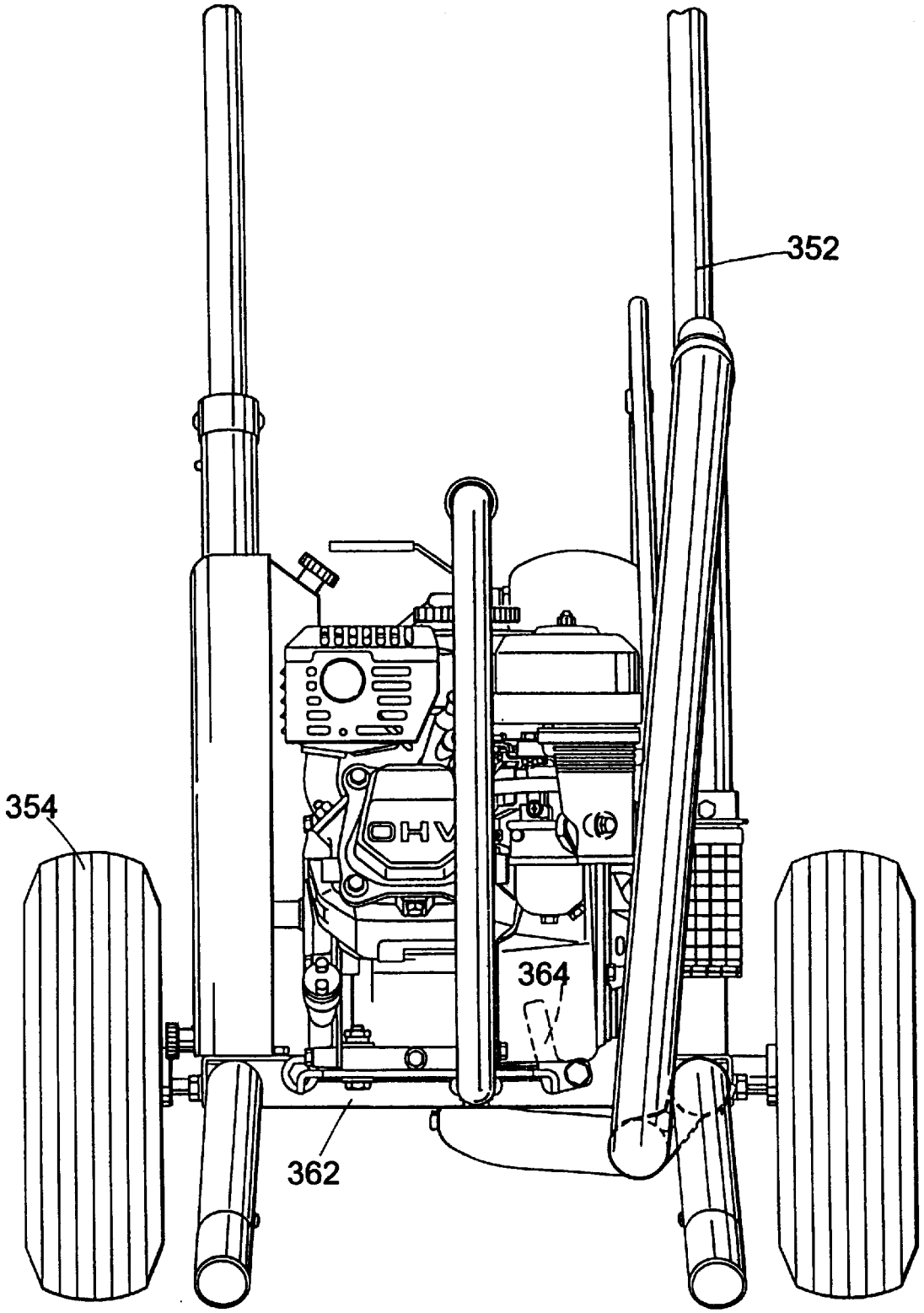
FIG. 15 is a front elevational view of the airless paint sprayer of FIG. 14.

With reference now to FIGS. 14 and 15, they illustrate an airless paint sprayer system according to the present invention and generally designated by the numeral 350. The paint sprayer system includes a frame 352 mounted on wheels 354. Mounted on the frame 352 is an engine generally designated as 356 which serves to move hydraulic fluid from a hydraulic fluid tank 358 to a hydraulic motor 360. The motor itself is mounted via a motor mount plate 362. A latch 364 is employed to selectively secure the motor in place. The latch which retains the motor plate 360 in its mating slot requires no tools so that users can easily change to a different type of motor. With this type of motor mount arrangement, the motor will not vibrate loose on the frame 352.

The invention has been described with reference to several preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A reciprocating hydraulic motor and pump assembly comprising:

a cylinder;

a piston disposed for reciprocation in said cylinder, said piston comprising:

a stem, a bore extending longitudinally in said stem, a piston head connected to one end of said stem, said piston head including a cavity communicating with said bore;

a spool disposed for longitudinal movement in said stem bore and said piston head cavity; and, a magnetic latching assembly disposed in said piston head cavity.

2. The assembly of claim 1 wherein said magnetic latching assembly comprises:

a first latch plate located adjacent one end of said piston head cavity; and, a second latch plate located adjacent another end of said piston head cavity.

3. The assembly of claim 2 wherein said magnetic latching assembly further comprises:

a housing slidably mounted on said spool, said housing having a first end and a second end;

a first magnetic plate mounted in said housing first end; and, a second magnetic plate mounted in said housing second end.

4. The assembly of claim 1 further comprising:

a collar mounted in said spool;

a trip rod mounted in said collar, said trip rod having a distal end and a proximal end; and, a first spring mounted on said distal end of said trip rod.

5. The assembly of claim 4 further comprising a second spring mounted on said proximal end of said trip rod and spaced from said first spring by said collar.

6. The assembly of claim 1 wherein said magnetic assembly is slidably mounted on said spool.

7. The assembly of claim 1 wherein said spool comprises:

an annular seal groove located on an outer periphery of said spool; and, a seal assembly mounted in said groove, said seal assembly comprising a metallic seal element.

8. The assembly of claim 7 wherein said seal assembly further comprises:

a metallic backing ring positioned in said seal groove behind said metallic seal element; and, an elastomeric packing ring positioned in said seal groove behind said backing ring.

9. A reciprocating hydraulic motor and pump assembly for an airless paint sprayer system comprising:

a cylinder;

a piston disposed for reciprocation in said cylinder, said piston comprising:

a stem having a bore extending longitudinally in said stem, a piston head connected to one end of said stem, said piston head including a cavity communicating with said bore;

a spool slidably mounted in said stem bore and said piston head cavity;

a magnetic latching assembly disposed in said piston head cavity; and, a displacement rod fastened to said piston rod.

10. The assembly of claim 9 further comprising:

a collar mounted in said spool;

a trip rod mounted in said collar, said trip rod having a distal end and a proximal end;

a first spring mounted on said distal end of said trip rod; and, a second spring mounted on said proximal end of said trip rod and spaced from said first spring by said collar.

11. The assembly of claim 10 wherein said cylinder comprises:

an end plate having a first aperture through which an end of said trip rod extends;

a slot in said end plate communicating with said first aperture and extending away therefrom; and, a second aperture in said end plate located at a second end of said slot, said second aperture having a larger diameter than said first aperture.

12. The assembly of claim 9 wherein said magnetic latching assembly comprises:

a housing slidably mounted on said spool, said housing having a first end and a second end;

a first magnetic plate mounted in said housing first end; and, a second magnetic plate mounted in said housing second end, wherein said magnetic assembly is slidably mounted on said spool.

13. The assembly of claim 12 wherein said magnetic latching assembly further comprises:

a first latch plate located adjacent one end of said piston head cavity; and, a second latch plate located adjacent another end of said piston head cavity.

14. The assembly of claim 9 wherein said spool comprises:

an annular seal groove located on an outer periphery of said spool; and, a seal assembly mounted in said groove, said seal assembly comprising a metallic seal element.

15. The assembly of claim 14 wherein said seal assembly further comprises:

a metallic backing ring positioned in said seal groove behind said metallic seal element; and, an elastomeric packing ring positioned in said seal groove behind said backing ring.

16. The assembly of claim 9 further comprising a filter body including a filter element and a ball valve mounted in communication therewith, said ball valve including a ball element which cooperates with a reversible seat.

17. A reciprocating hydraulic motor and pump assembly comprising:

a cylinder;

a piston disposed for reciprocation in said cylinder, said piston comprising:

a stem, having a bore extending longitudinally therein, a piston head connected to one end of said stem, said piston head including a cavity communicating with said bore;

a spool disposed for longitudinal movement in said stem bore and said piston head cavity; and, a magnetic latching assembly disposed in said piston head cavity, said latching assembly comprising:

a first latch plate located adjacent one end of said piston head cavity, a second latch plate located adjacent another end of said piston head cavity, a magnetic plate slidably mounted on said spool and located in said piston head cavity, said magnetic plate being reciprocated between said first latch plate and said second latch plate by a movement of said spool.

18. The assembly of claim 17 further comprising:

a collar mounted in said spool;

a trip rod mounted in said collar, said trip rod having a distal end and a proximal end;

a first spring mounted on said distal end of said trip rod; and, a second spring mounted on said proximal end of said trip rod and spaced from said first spring by said collar.

19. The assembly of claim 18 wherein said spool comprises:

an annular seal groove located on an outer periphery of said spool; and, a seal assembly mounted in said groove, said seal assembly comprising a metallic seal element.

20. The assembly of claim 19 wherein said seal assembly further comprises:

a metallic backing ring positioned in said seal groove behind said metallic seal element; and, an elastomeric packing ring positioned in said seal groove behind said backing ring.

* * * * *